United States Patent [19]

Windorski

[11] Patent Number: 4,986,440

[45] Date of Patent: Jan. 22, 1991

[54] DISPENSER FOR A STACK OF NOTE PAPER

[75] Inventor: David C. Windorski, St. Paul, Minn.

[73] Assignee: Minnesota Mining and Manufacturing Company, Saint Paul, Minn.

[21] Appl. No.: 448,986

[22] Filed: Dec. 12, 1989

Related U.S. Application Data

[60] Division of Ser. No. 202,138, Jun. 3, 1988, Pat. No. 4,921,127, which is a continuation-in-part of Ser. No. 29,172, Mar. 23, 1987, Pat. No. 4,796,781.

[51] Int. Cl.[5] ..... B65H 1/00

[52] U.S. Cl. ..... 221/45; 221/52; 312/61

[58] Field of Search ..... 221/52, 56, 57, 61, 221/45, 63, 33, 312 C, 279; 312/61

[56] References Cited

U.S. PATENT DOCUMENTS

| | | | |
|---|---|---|---|
| 1,026,549 | 5/1912 | Almond . | |
| 1,377,565 | 5/1921 | Dickerson . | |
| 1,508,020 | 9/1924 | Horwitt . | |
| 1,696,556 | 12/1928 | Schofer . | |
| 1,707,578 | 4/1929 | Shaffer . | |
| 2,082,765 | 6/1937 | Krueger | 312/61 |
| 2,237,532 | 4/1941 | Posnack | 281/44 |
| 2,609,219 | 9/1952 | Marano | 281/44 |
| 2,802,567 | 8/1957 | Covel | 206/57 |
| 2,872,067 | 2/1959 | Gessner et al. | 206/65 |
| 3,223,235 | 12/1965 | Knip | 206/74 |
| 4,046,281 | 9/1977 | Voegeli | 221/23 |
| 4,197,964 | 4/1980 | Pryor | 221/50 |
| 4,796,781 | 1/1989 | Windorski | 221/45 |

FOREIGN PATENT DOCUMENTS

| | | |
|---|---|---|
| 1016522 | 11/1952 | France . |
| 24066 | of 1904 | United Kingdom . |

*Primary Examiner*—H. Grant Skaggs

*Attorney, Agent, or Firm*—Donald M. Sell; Walter N. Kirn; William Huebsch

[57] ABSTRACT

A dispenser for sheets of note paper disposed in a stack with each of the sheets having a narrow band of adhesive coated on one surface along one edge by which the sheets are adhered together and with the sheets being stacked with the band of adhesive of adjacent sheets at alternate opposite edges of the stack. The dispenser comprises a base having a top surface with a generally planar support surface portion adapted to support a lower surface of the stack. Also included is a body having a bottom surface including spaced pressure surface portions adapted to engage and be supported on an upper surface of the stack adjacent the edges of the sheets along which the narrow bands of adhesive are coated with the spaced pressure surface portions engaging the upper surface of the sheets at predetermined distances from the edges of the sheets along which the narrow bands of adhesive are coated, and convex arcuate surface portions between the pressure surface portions and a top surface defining a slot through and extending centrally across the body part. The convex arcuate surface portions have radii with a dimension as least as large as the predetermined distances to restrict curling of sheets of paper pulled from the dispenser through the slot, and the body has sufficient weight to afford pulling a sheet from the stack through the slot without substantially lifting the body from the stack.

4 Claims, 7 Drawing Sheets

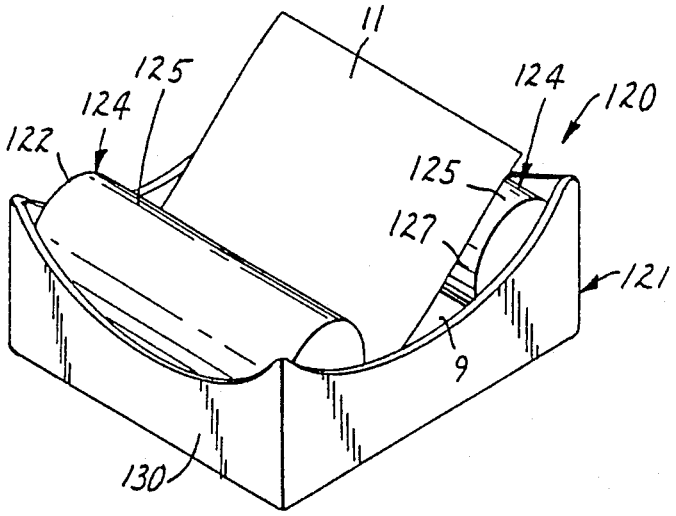
FIG. 21
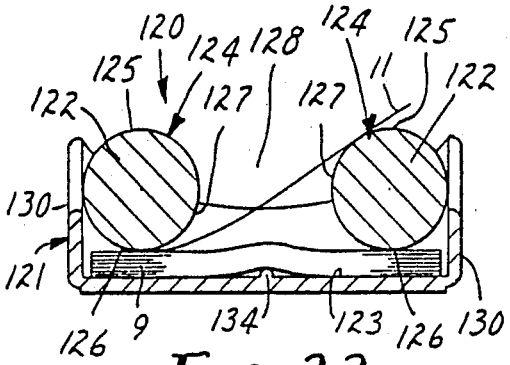
FIG. 22
FIG. 23
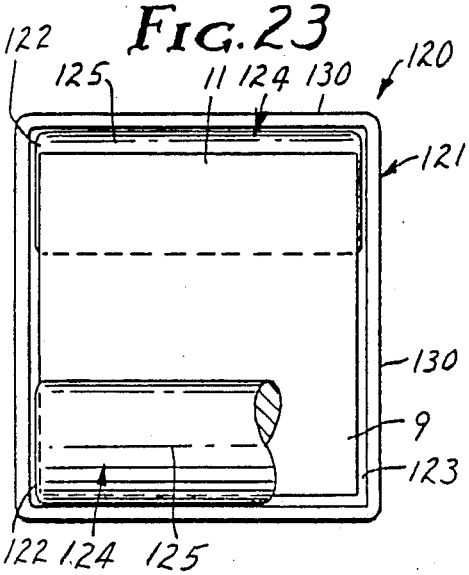

DISPENSER FOR A STACK OF NOTE PAPER

This application is a division of application Ser. No. 07/202,138 filed June 3, 1988, now U.S. Pat. No. 4,921,127 issued May 1, 1990, which is a continuation-in-part of U.S. patent application Ser. No. 07/029,172 filed Mar. 23, 1987, now U.S. Pat. No. 4,796,781, issued Jan. 10, 1989.

TECHNICAL FIELD

The present invention relates to dispensers for sheets of note paper disposed in a stack with each of the sheets having a narrow band of adhesive coated on one surface along one edge by which the sheets are adhered together and with the sheets being stacked with the band of adhesive of adjacent sheets at alternate opposite edges of the stack.

BACKGROUND ART

One dispenser for such sheets from such a stack is described in U.S. Pat. No. 4,416,392, assigned to the assignee of this application, wherein the stack of sheets is disposed in a box and the sheets are dispensed through a slot in the top of the box and centrally disposed parallel to the opposite edges of the sheets which are coated with the bands of adhesive. Alternately, U.S. Pat. No. 4,416,392 discloses a dispenser for such a stack of sheet material wherein a base is provided for supporting a removable cover within which is disposed the stack of sheet material. The cover is provided with an opening in its top wall and the stack of sheets are urged toward the top wall by a spring. The top wall is formed by two inclined portions which terminate at the dispensing opening. This dispenser comprises four basic parts to dispense the stack of sheets, and the sharp edges in the dispenser at the opening cause sheets that are dispensed to become stressed during the dispensing action about the edges of the opening so that the sheets retain a curl after they are dispensed.

A second U.S. Pat. No. 4,653,666, assigned to the assignee of this application discloses a further embodiment of a dispenser for such a stack of sheets. This dispenser comprises a box which fits about the stack of sheets and has a centrally disposed opening transverse to the edges coated with the adhesive. A spring member in the box presses the stack of sheets toward the opening. Extending from the top wall of the box and into the opening are flexible polymeric flaps which during dispensing of the sheets bend to form arcuate walls about which the sheets are drawn as they are dispensed. This structure thus avoids the development of any curl in the dispensed sheets so that the sheets, after being dispensed and positioned on a receptor lay generally flat along the surface of the receptor and thus are not as subject to becoming dislodged as they would be had a curl been present in the dispensed sheet. This dispenser, as noted however, comprises a number of parts, and because it is formed from a box which is not refillable it lacks certain advantages. Further, the lightweight nature of the dispenser does not make it convenient as a desk dispenser since the sheets could not be removed from the box with one hand.

SUMMARY OF THE INVENTION

The present invention provides a dispenser for sheets of note paper disposed in a stack with each of the sheets having a narrow band of adhesive coated on one surface along one edge by which the sheets are adhered together and with the sheets being stacked with the band of adhesive of adjacent sheets at alternate opposite edges of the stack, which dispenser is refillable, affords single hand removal of sheets from the dispenser, includes few parts, can be made to be very attractive for use on the desk top, and does not leave a curl in dispensed sheets of paper.

The dispenser according to the present invention comprises a base part having a bottom surface adapted to be supported on a horizontal support surface and a top surface comprising a generally planar support surface portion adapted to support a lower surface of the stack; and a body part having a bottom surface including spaced pressure surface portions adapted to engage and be supported on the upper surface of the stack adjacent the edges of the sheets along which the narrow bands of adhesive are coated with the spaced pressure surface portions engaging an upper surface of the sheets at predetermined distances from the edges of the sheets along which the narrow bands of adhesive are coated, and convex arcuate surface portions between the pressure surface portions and a top surface of the body part defining a slot through and extending centrally across the body part. The convex arcuate surface portions have radii having a dimension at least as great as the predetermined distances to restrict curling of sheets of paper pulled from the dispenser through the slot, and the body part has sufficient weight (e.g., about ½ to 1 ½pound) to afford pulling a sheet from the stack through the slot without substantially lifting the body part from the stack.

BRIEF DESCRIPTION OF THE DRAWINGS

The present invention will be further described with reference to the accompanying drawing wherein like reference numerals refer to like parts in the several views, and wherein:

FIG. 21 is a perspective view of a sixth alternative embodiment of a dispenser according to the present invention in which a stack of sheets to be dispensed is positioned:

FIG. 22 is a vertical sectional view of the dispenser and stack of sheets of FIG. 21;

FIG. 23 is a fragmentary top view of the dispenser and stack of sheets of FIG. 21;

DETAILED DESCRIPTION

Figure 1:
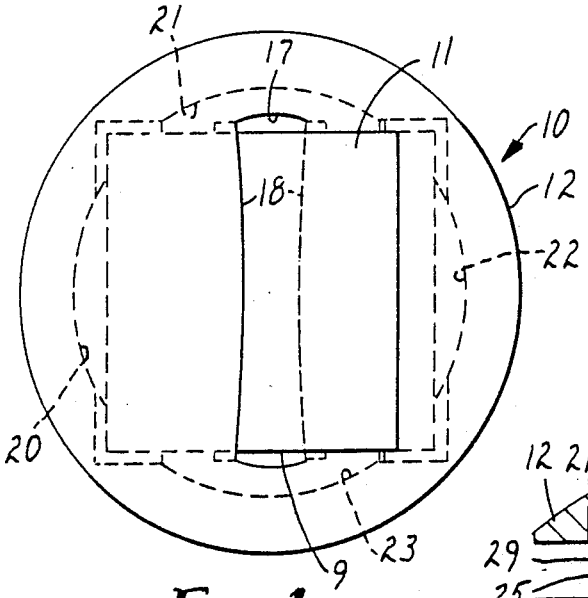
FIG. 1 is a top plan view of a first embodiment of a dispenser according to the present invention in which a stack of sheet to be dispensed is positioned.

Referring now to FIGS. 1 through 5, there is disclosed a first embodiment of a dispenser 10 according to the present invention for a stack 9 of sheets 11 wherein each sheet 11 has a narrow band of adhesive coated on one surface along one edge thereof, and the sheets 11 are placed in the stack 9 with the band of adhesive of adjacent sheets 11 being coated at alternate opposite edges of the stack 9.

The dispenser 10 comprises a generally circular body part or body 12 and a generally circular base part or base 14.

The base 14 has a bottom surface adapted to be supported on a horizontal support surface and a top surface comprising a generally planar support surface portion 26 adapted to support the lower surface of the stack 9.

The body 12 has a top surface, and a bottom surface including spaced pressure surface portions 16 adapted to engage and be supported on the upper surface of the stack 9 parallel to and adjacent the edges of the sheets 11 along which the narrow bands of adhesive are coated with the spaced pressure surface portions 16 engaging the upper surface of the stack 9 at predetermined distances (e.g., up to about ½ inch for stacks 3 inches wide) from the edges of the sheets 11 along which the narrow bands of adhesive are coated, and convex arcuate surface portions 15 between the pressure surface portions 16 and the top surface of the body 12 defining a slot 17 having opposite edges 18 through and extending centrally across the body 12. The convex arcuate surface portions 15 have radii with dimensions at least as great as said predetermined distances to restrict curling of sheets of paper pulled from the dispenser through the slot 17, and the body 12 has sufficient weight (e.g., about 1.5 pounds by being formed of metal, such as brass) to counteract the forces applied thereagainst during the dispensing of sheet 11 such that it is not displaced, tilted or substantially lifted from the top of the stack 9 as a sheet 11 is pulled from the stack 9 through the slot 17.

The bottom of the body 12 is recessed to receive an upper portion of the stack of sheets 11 with its upper surface against the pressure surface portions 16 and has at least two, but as illustrated four, deeper recesses 20, 21, 22, and 23 which are formed about the recess to receive projections, as will be described hereinafter, on the base 14 to nest the body 12 and the base 14.

Figure 3:
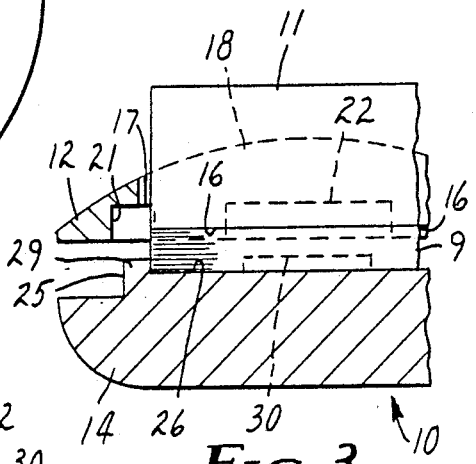
FIG. 3 is a fragmentary transverse sectional view of the dispenser and stack of sheets of FIG. 1.
Figure 2:
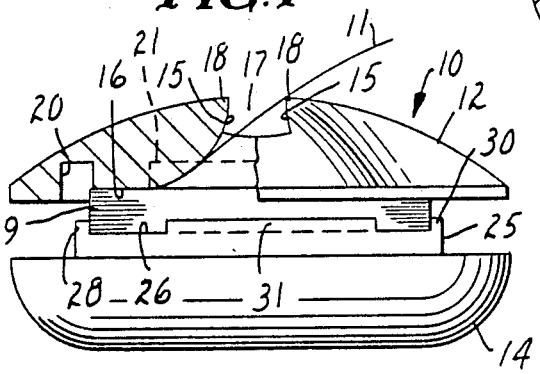
FIG. 2 is a side elevational view, partly in section, of the dispenser and stack of sheets of FIG. 1.
Figure 4:
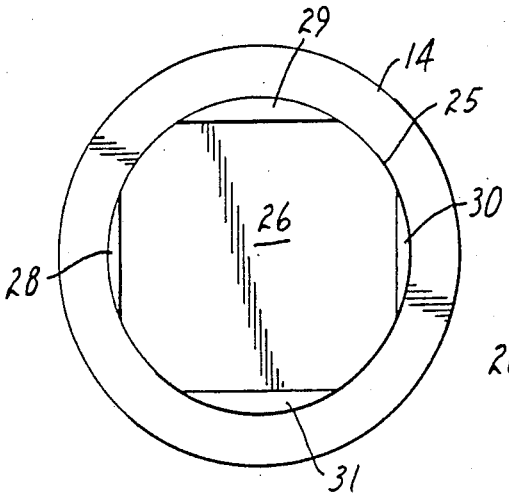
FIG. 4 is a top plan view of a base part included in the dispenser of FIG. 1.
Figure 5:
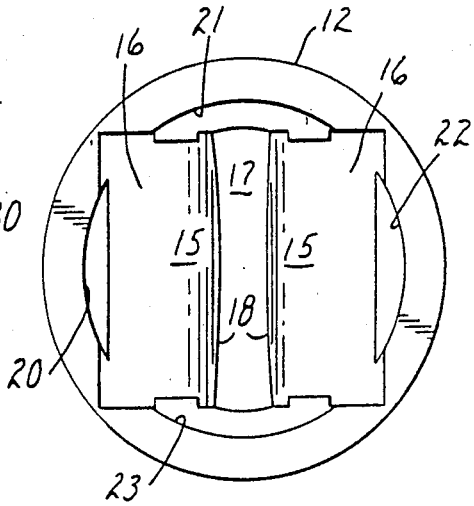
FIG. 5 is a bottom plan view of a body part included in the dispenser of FIG. 1.

As noted in FIGS. 2 and 3, the base 14 is configured with a circular outer periphery corresponding to that of the body 12 and has a pedestal or platform 25 in the center portion thereof. The pedestal 25 has an outer periphery which is also circular so that is corresponds to the configuration of the base 14 but has the generally rectangular support surface portion 26 of the top surface for supporting the stack 9 of sheets 11. Positioned about the support surface portion 26 are projections 28, 29, 30, and 31. The projections 28–31 are shaped to define the rectangular support surface portion 26 and project thereabove to be received in the recesses 20, 21, 22, and 23 of the body 12. These projections 18–31 serve also to nest the stack 9 on the support surface portion 26 such that the stack 9 is restricted from movement in the plane of its sheets with respect to the support surface portion 26. The support surface portion 26 will strike the pressure surface portions 16 before other parts of the body 12 and base 14 are in contact.

Referring now to the embodiment of FIGS. 6, 7, 8, and 9, it will be noted that the configuration differs and the rectangular recess is defined in the base rather than the body and that the projections project from the body into cooperating recesses in the base.

Figure 6:
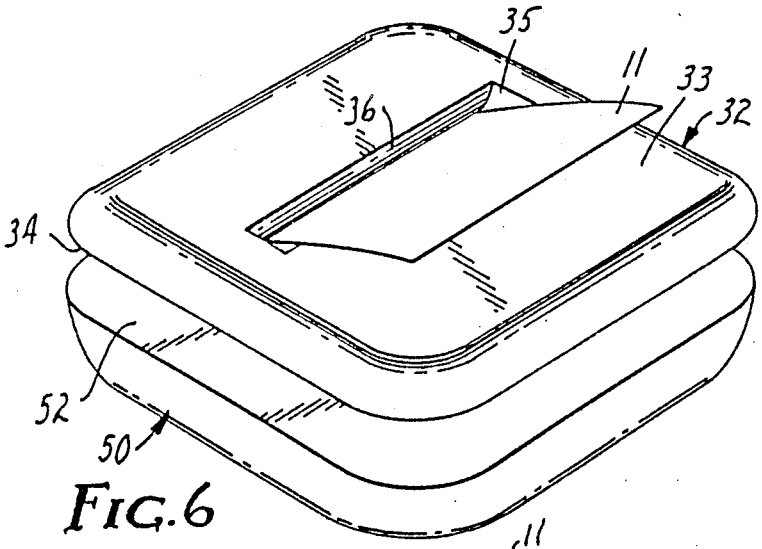
FIG. 6 is a perspective view of a second alternative embodiment of a dispenser according to the present invention in which a stack of sheets to be dispensed is positioned.
Figure 7:
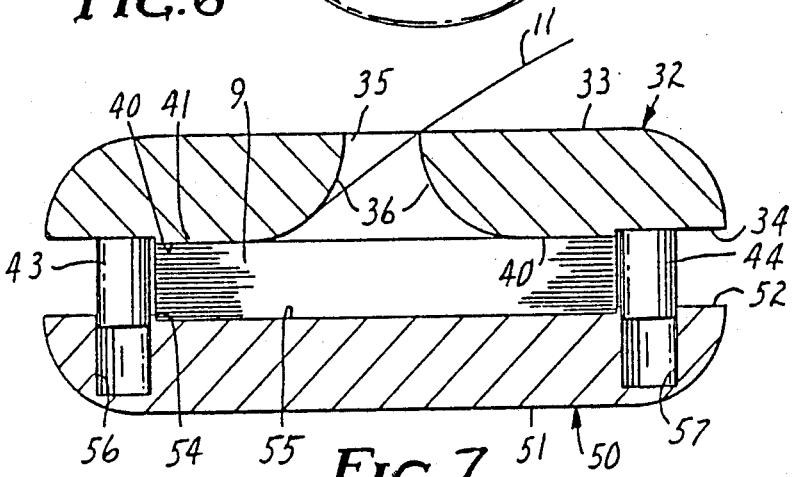
FIG. 7 is a longitudinal vertical sectional view of the dispenser and stack of sheets of FIG. 6.
Figure 8:
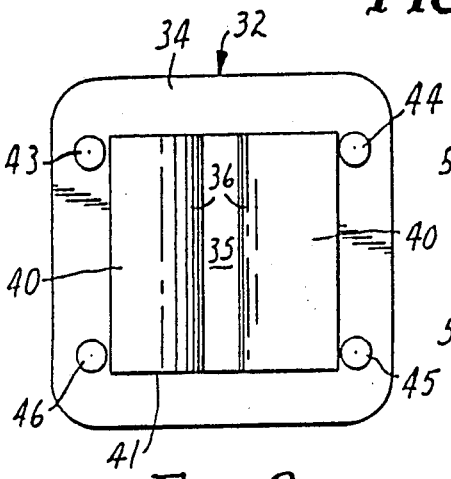
FIG. 8 is a bottom plan view of a body part included in the dispenser of FIG. 6.
Figure 9:
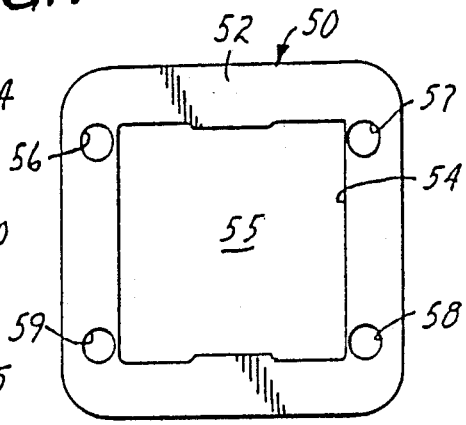
FIG. 9 is a top plan view of a base part of the dispenser of FIG. 6.

FIG. 6 illustrates a dispenser having a body 32 with a top surface 33 and a bottom surface 34. The bottom surface 34 includes spaced pressure surface portions 40 adapted to engage and be supported on the upper surface of the stack 9 parallel to and adjacent the edges of the sheets 11 along which the narrow bands of adhesive are coated with the spaced pressure surface portions 40 engaging the upper surface of the sheets 11 at predetermined distances from the edges of the sheets 11 along which the narrow bands of adhesive are coated, and convex arcuate surface portions 36 between the pressure surface portions 40 and the top surface 33 defining a slot 35 through and extending centrally across the body 32. The convex arcuate surface portions 36 have radii with dimensions at least as great as said predetermined distances to restrict curling of sheets of paper pulled from the dispenser through the slot 35, and the body 32 has sufficient weight to afford pulling a sheet 11 from the stack 9 through the slot 35 without substantially lifting the body 32 from the stack 9. The pressure surface portions 40 are on a platform or pedestal 41 that projects below surrounding portions of the bottom surface 34 of the body 32. Projecting further from the bottom surface 34 of the body are also a plurality of cylindrical projections 43, 44, 45, and 46 which are disposed adjacent the periphery of the pressure surface portions 40 to restrict the stack 9 of sheets 11 from moving with respect to the pressure surface portions 40. The base 50 is provided with a bottom surface 51 adapted to be supported on a horizontal support surface and a top surface 52 which has a generally rectangular shaped recessed area 54 shaped to receive a stack of sheets 11 and defining a generally planar support surface portion 55 adapted to support the lower surface of the stack 9. The depth of the recess 54 to the support surface portion 55 does not exceed the height of the pedestal from surface 34 to the pressure surface portions 40 such that the last sheet 11 of a stack 9 would be dispensed from the recess 54 before contact was made between the pressure surface portions 40 and the support surface portion 55 in the recess 54, before surface 34 touches surface 52 and before the extended ends of projections 43–46 strike the bottom of recesses 56–59. Surrounding the periphery of the recess 54 are the series of recesses 56, 57, 58, and 59 shaped to cooperate with the projections 43, 44, 45, and 46 to nest the body 32 with the base 50.

In each of the dispensers 10 and 32 the body 12 or 33 is preferably formed to have a weight of between about 16 ounces and 24 ounces to exceed the force of drawing a sheet 11 through the slot 17 or 35 and peeling the sheet 11 from the surface of the next adjacent sheet 11 in the stack 9. In the dispenser illustrated in FIGS. 6–9 the projections 43, 44, 45, and 46 may at all times be engaged in the openings 56, 57, 58, and 59 to restrict movement of the body 32 with respect to the base 50 if the height of the stack 9 is limited. The engagement of the projections with the base or projections in the base contacting the body add resistance to any movement and thus the amount of weight in the body could be reduced. The weighted body in the above-stated range however is preferred for the dispenses described above in that it makes the dispenser more stable on the desk so that the total dispenser is not moved upon dispensing action on a sheet of note paper. The weight of the body also results from factors such as the coefficient of friction of the walls 15 and 36 and the paper weight and finish. The body and base can be formed of the same material or different materials to provide an attractive dispenser, e.g. brass and walnut, plastic and a wood, wood with metal projections 43–46 for weight, etc. The thickness of the body also is of assistance in having the free end of the sheet 11 projecting upward where it is easily grasped to be withdrawn from the dispenser.

Figure 10:
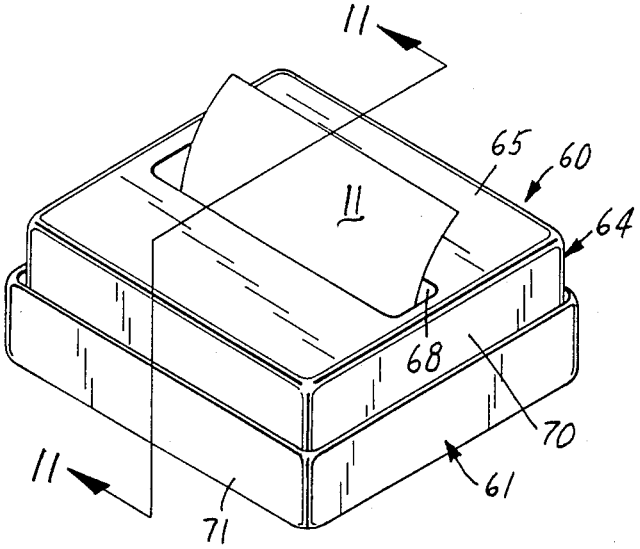
FIG. 10 is a perspective view of a third alternative embodiment of a dispenser according to the present invention in which a stack of sheets to be dispensed is positioned.
Figure 11:
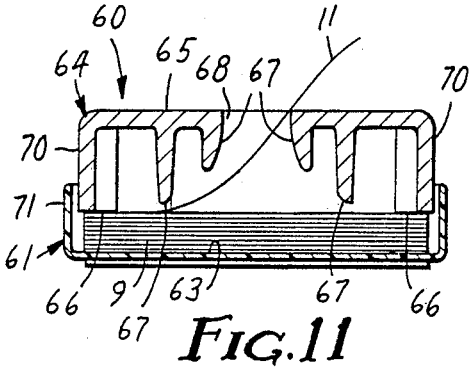
FIG. 11 is a sectional view taken approximately along line 11—11 of FIG. 10.
Figure 12:
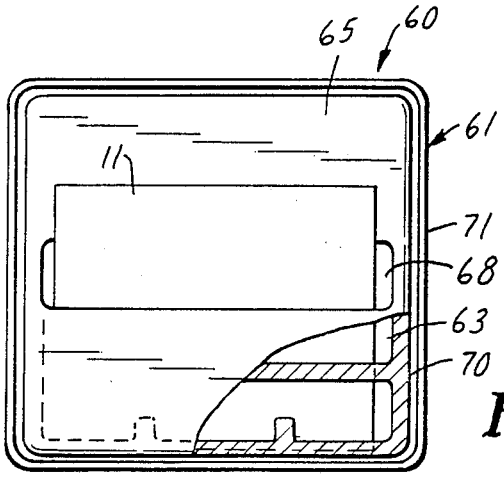
FIG. 12 is a top plan view, partially in section, of the dispenser of FIG. 10.
Figure 13:
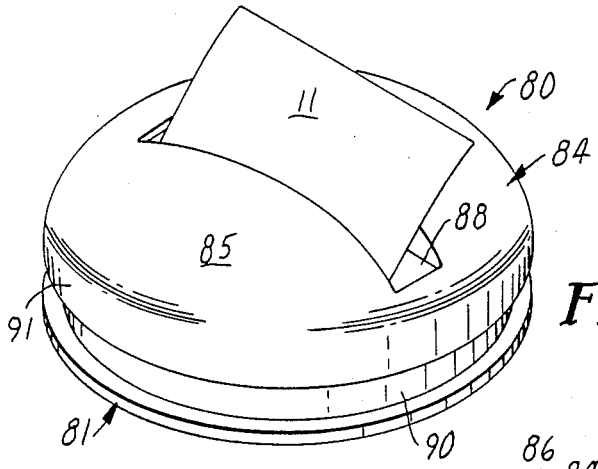
FIG. 13 is a perspective view of a fourth alternative embodiment of a dispenser according to the present invention in which a stack of sheet to be dispensed is positioned.

Referring now to FIGS. 10, 11 and 12 there is illustrated a third embodiment of a dispenser 60 according to the present invention for sheets 11 of note paper disposed in a stack 9 having upper and lower surfaces with each of the sheets 11 having a narrow band of adhesive coated on one surface along one edge by which the sheets 11 are adhered together with the sheets 11 being stacked with the band of adhesive of adjacent sheets 11 at alternate opposite edges of the stack 9.

The dispenser 60 comprises a base part or base 61 having a bottom surface adapted to be supported on a horizontal support surface and a top surface comprising a generally planar support surface portion 63 adapted to support the lower surface of the stack 9, and a body part or body 64 having a top surface 65, and a bottom surface including spaced pressure surface portions 66 adapted to engage and be supported on the upper surface of the stack 9 adjacent the edges of the sheets 11 along which the narrow bands of adhesive are coated with the spaced pressure surface portions 66 engaging the upper surface of the sheets at predetermined distances (i.e., about ⅛ to ½ inch) from the edges of the sheets 11 along which the narrow bands of adhesive are coated, and convex arcuate surface portions 67 between the pressure surface portions 66 and the top surface 65 defining a slot 68 through and extending centrally across the body 64. The convex arcuate surface portions 67 have radii with dimensions at least as great as said predetermined distances to restrict curling of sheets 11 of paper pulled from the dispenser through the slot 68, and the body 64 is a metal casting (e.g., of zinc, at least 8 ounces in weight) so that it has sufficient weight to afford pulling one of the sheets 11 from the stack 9 through the slot 68 without substantially lifting the body 64 from the stack 9.

The body 64 has a periphery 70 disposed at generally a right angle to the support portion 63 of the top surface, and the base 61 has an upwardly projecting peripheral wall 71 adapted to project along the periphery 70 of the body 64 with the stack 9 between the body 64 and base 61 to provide means for positioning the body 64 above the base 61. The peripheral wall 71 has rectangularly disposed portions adapted to receive the sides of the stack 9 in close fitting relationship; and the periphery 70 being rectangular together with the relative orientation of the base 61 and body 64 provided by the rectangular periphery 70 and the peripheral wall 71 provides means for locating the stack 9 with the edges of the sheets 11 along which the narrow bands of adhesive are coated generally parallel to the arcuate surface portions 67 and with the slot 68 extending generally transversely across the stack 9 centrally between those edges.

Referring now to FIGS. 13, 14, 15 and 16 there is illustrated a fourth embodiment of a dispenser 80 according to the present invention for sheets 11 of note paper disposed in a stack 9 having upper and lower surfaces with each of the sheets 11 having a narrow band of adhesive coated on one surface along one edge by which the sheets 11 are adhered together with the sheets 11 being stacked with the band of adhesive of adjacent sheets 11 at alternate opposite edges of the stack 9.

The dispenser 80 comprises a base part or base 81 having a bottom surface adapted to be supported on a horizontal support surface and a top surface comprising a generally planar support portion 83 adapted to support the lower surface of the stack 9, and a body part or body 84 having a top surface 85, and a bottom surface including spaced pressure surface portions 86 adapted to engage and be supported on the upper surface of the stack 9 parallel to and adjacent the edges of the sheets 11 along which the narrow bands of adhesive are coated with the spaced pressure surface portions 86 engaging the upper surface of the sheets at predetermined distances from the edges of the sheets 11 along which the narrow bands of adhesive are coated, and convex arcuate surface portions 87 between the pressure surface portions 86 and the top surface 85 defining a slot 88 through and extending centrally across the body 84. The convex arcuate surface portions 87 have radii having dimensions at least as great as said predetermined distances to restrict curling of sheets 11 of paper pulled from the dispenser through the slot 88, and the body 84 is a metal casting (e.g., of brass) so that it has sufficient weight to afford pulling one of the sheets 11 from the stack 9 through the slot 88 without substantially lifting the body 84 from the stack 9.

Figure 15:
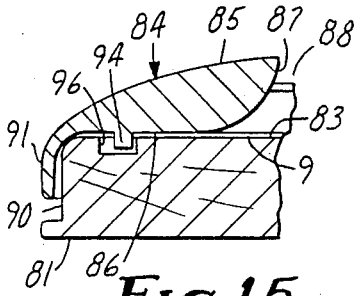
FIG. 15 is a fragmentary vertical sectional view of the dispenser of FIG. 13 with the stack of sheets between parts of the dispenser greatly diminished in height.
Figure 14:
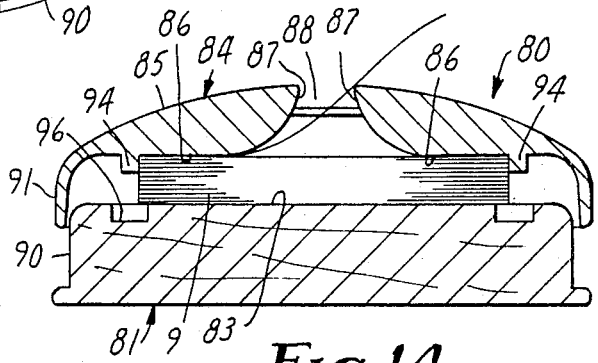
FIG. 14 is a vertical sectional view of the dispenser and stack of sheets of FIG. 13.
Figure 16:
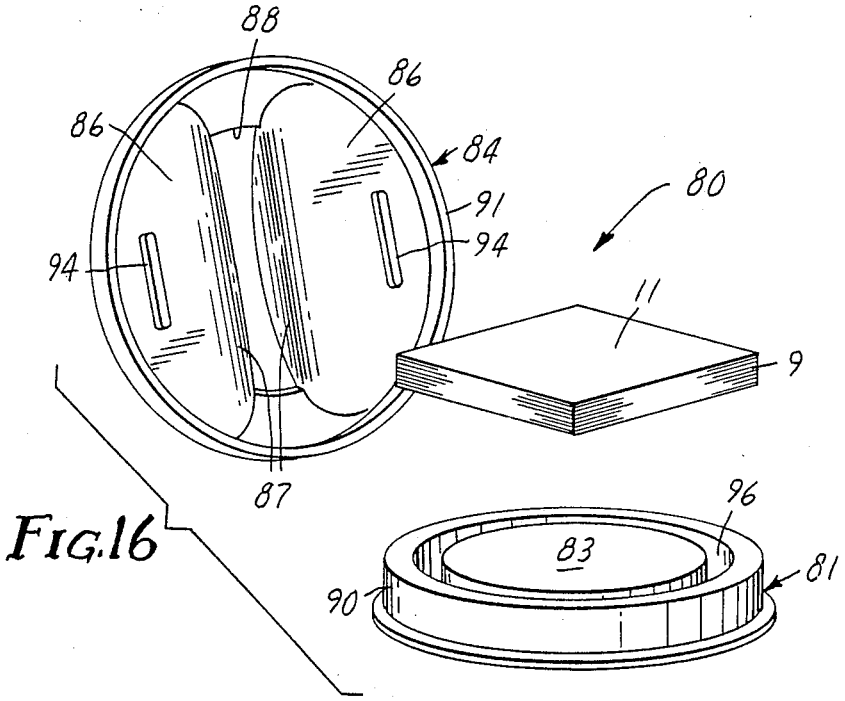
FIG. 16 is an exploded view of the dispenser and stack of sheets of FIG. 13.
Figure 17:
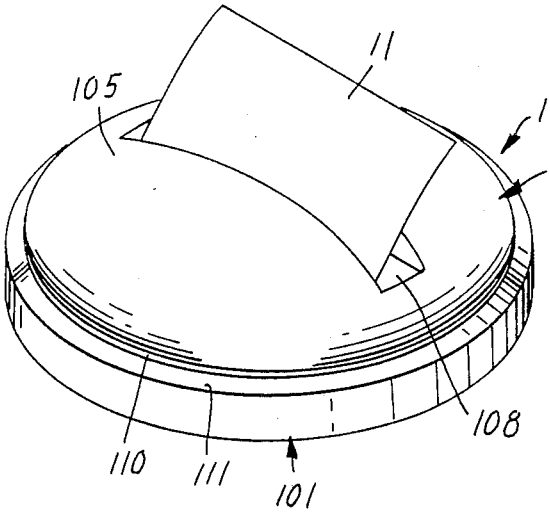
FIG. 17 is a perspective view of a fifth alternative embodiment of a dispenser according to the present invention in which a stack of sheets to be dispensed is positioned.

The base 81 has a cylindrical periphery 90 disposed at generally a right angle to the support surface portion 83 of its top surface, and the body 84 has a downwardly projecting generally cylindrical peripheral wall 91 adapted to project along the periphery 90 of the base 81 with the stack 9 between the body 84 and base 81 to provide means for positioning the body 84 above the base 81. The body 84 has spaced locating lugs 94 projecting toward the base 61 adapted to receive opposite sides of the stack 9 in close fitting relationship to provide means for locating the stack 9 with the edges of the sheets 11 along which the narrow bands of adhesive are coated generally parallel to the arcuate surface portions 87 and with the slot 88 extending generally transversely across the stack 9 centrally between those edges. The base 81 has a circular groove 96 recessed from the support surface 83 adapted to receive the locating lugs 94 in any orientation of the slot 88 transverse to the base 81 when the thickness of the stack 9 is less than the distance the locating lugs 94 project from the pressure surface portions 86 (as is illustrated in FIG. 15) to afford dispensing the last sheets in the stack 9.

Referring now to FIGS. 17, 18, 19 and 20 there is illustrated a fifth embodiment of a dispenser 100 according to the present invention for sheets 11 of note paper disposed in a stack 9 having upper and lower surfaces with each of the sheets 11 having a narrow band of adhesive coated on one surface along one edge by which the sheets 11 are adhered together with the sheets 11 being stacked with the band of adhesive of adjacent sheets 11 at alternate opposite edges of the stack 9.

The dispenser 100 comprises a base part or base 101 having a bottom surface adapted to be supported on a horizontal support surface and a top surface comprising a generally planar support surface portion 103 adapted to support the lower surface of the stack 9; and a body part or body 104 having a top surface 105, and a bottom surface including spaced pressure surface portions 106 adapted to engage and be supported on the upper surface of the stack 9 parallel to and adjacent the edges of the sheets 11 along which the narrow bands of adhesive are coated with the spaced pressure surface portions 106 engaging the upper surface of the sheets at predetermined distances from the edges of the sheets 11 along which the narrow bands of adhesive are coated, and convex arcuate surface portions 107 between the pressure surface portions 106 and the top surface 105 defining a slot 108 through and extending centrally across the body 104. The convex arcuate surface portions 107 have radii with dimensions at least as great as said predetermined distances to restrict curling of sheets 11 of paper pulled from the dispenser through the slot 108, and the body 104 is a metal casting (e.g., of brass) so that it has sufficient weight to afford pulling one of the sheets 11 from the stack 9 through the slot 108 without substantially lifting the body 104 from the stack 9.

Figure 19:
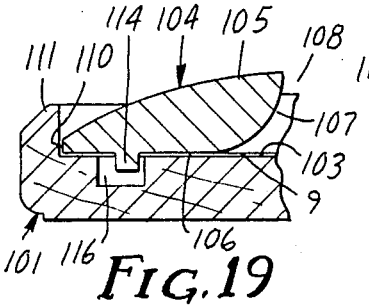
FIG. 19 is a fragmentary vertical sectional view of the dispenser of FIG. 17 with the stack of sheets between parts of the dispenser greatly diminished in height.
Figure 18:
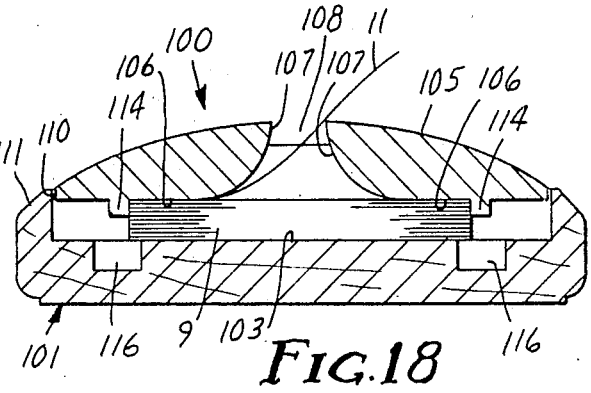
FIG. 18 is a vertical sectional view of the dispenser and stack of sheets of FIG. 17.
Figure 20:
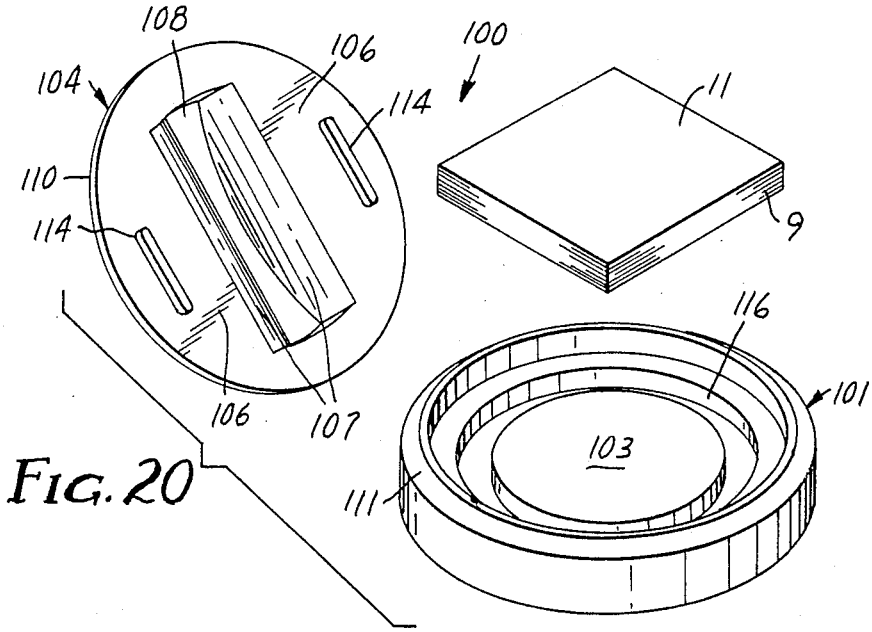
FIG. 20 is an exploded view of the dispenser and stack of sheets of FIG. 17.

The body 104 has a cylindrical periphery 110 disposed at generally a right angle to the support surface portion 103 of the top surface, and the base 101 has an upwardly projecting generally cylindrical peripheral wall 111 adapted to project along the periphery 110 of the body 104 with the stack 9 between the body 104 and base 101 to provide means for positioning the body 104 above the base 101. The body 104 has spaced locating lugs 114 projecting toward the base 101 adapted to receive opposite sides of the stack 9 in close fitting relationship to provide means for locating the stack 9 with the edges of the sheets 11 along which the narrow bands of adhesive are coated generally parallel to the arcuate surface portions 107 and with the slot 108 extending generally transversely across the stack 9 centrally between those edges. The base 101 has a circular groove 116 recessed from the support surface 103 adapted to receive the locating lugs 114 in any orientation of the slot 108 transverse to the base 101 when the thickness of the stack 9 is less than the distance the locating lugs 114 project past the pressure surface portions 106 (as is illustrated in FIG. 19) to afford dispensing the last sheets in the stack 9.

Referring now to FIGS. 21, 22 and 23 there is illustrated a sixth embodiment of a dispenser 120 according to the present invention for sheets 11 of note paper disposed in a stack 9 having upper and lower surfaces with each of the sheets 11 having a narrow band of adhesive coated on one surface along one edge by which the sheets 11 are adhered together with the sheets 11 being stacked with the band of adhesive of adjacent sheets 11 at alternate opposite edges of the stack 9.

The dispenser 120 comprises a base part or base 121 having a bottom surface adapted to be supported on a horizontal support surface and a top surface comprising a generally planar support surface portion 123 adapted to support the lower surface of the stack 9, and a body part or body 124 formed by two cylinders 122 having a top surface 125, and a bottom surface including spaced pressure surface portions 126 adapted to engage and be supported on the upper surface of the stack 9 parallel to and adjacent the edges of the sheets 11 along which the narrow bands of adhesive are coated with the spaced pressure surface portions 126 engaging the upper surface of the sheets at predetermined distances from the edges of the sheets 11 along which the narrow bands of adhesive are coated, and convex arcuate surface portions 127 between the pressure surface portions 126 and the top surface 125 defining a slot 128 through and extending centrally across the body 124. The convex arcuate surface portions 127 have radii with dimensions at least as great as said predetermined distances to restrict curling of sheets 11 of paper pulled from the dispenser through the slot 128, and the cylinders forming the body 124 are of metal (e.g., of brass or zinc) so that the body 124 has sufficient weight to afford pulling one of the sheets 11 from the stack 9 through the slot 128 without substantially lifting the guiding cylinder 122 from the stack 9.

The base 121 has an upwardly projecting peripheral wall 130 projecting at right angles away from the support surface portion 123. The peripheral wall 130 has rectangularly disposed portions adapted to receive the sides of the stack 9 in close fitting relationship, and the two cylinders 122 forming the body 124 are received within the peripheral wall 130 with the axes of the cylinders 122 parallel to and adjacent the opposite edges of the sheets 11 along which the narrow bands of adhesive are coated with the orientation provided for the cylinders 122 and the stack 9 by the peripheral wall 130 providing means for locating the stack 9 with the edges of the sheets along which the narrow bands of adhesive are coated generally parallel to the arcuate surface portions and with the slot extending generally transversely across the stack 9 centrally between those edges, and means for positioning the body 124 above the base 121.

The base 121 has a central rib 134 generally parallel to the cylinders 122 which slightly raises the center of the stack to insure that the cylinders 122 will have a normal tendency to roll to positions against the peripheral wall 130.

Figure 24:
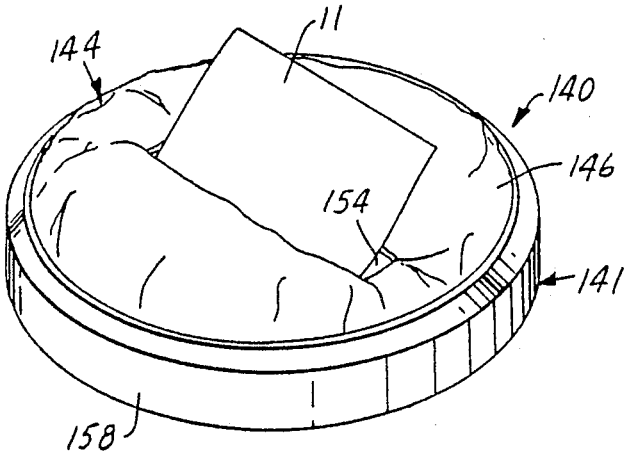
FIG. 24 is a perspective view of a seventh alternative embodiment of a dispenser according to the present invention in which a stack of sheets to be dispensed is positioned.
Figure 25:
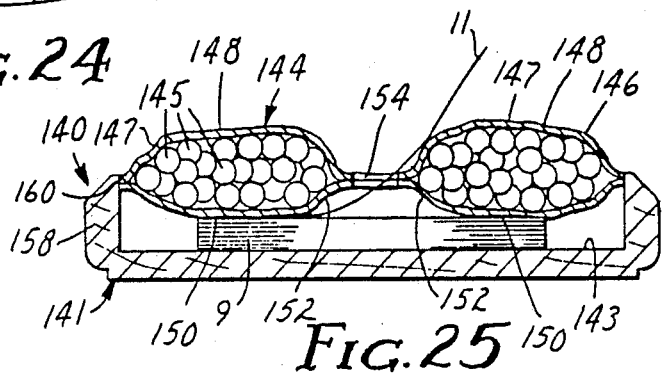
FIG. 25 is a vertical sectional view of the dispenser and stack of sheets of FIG. 24.

Referring now to FIGS. 24 and 25 there is illustrated a seventh embodiment of a dispenser 140 according to the present invention for sheets 11 of note paper disposed in a stack 9 having upper and lower surfaces with each of the sheets 11 having a narrow band of adhesive coated on one surface along one edge by which the sheets 11 are adhered together with the sheets 11 being stacked with the band of adhesive of adjacent sheets 11 at alternate opposite edges of the stack 9.

The dispenser 140 comprises a base part or base 141 having a bottom surface adapted to be supported on a horizontal support surface and a top surface comprising a generally planar support surface portion 143 adapted to support the lower surface of the stack 9, and a body part or body 144 formed by a multiplicity of steel balls 145 within a flexible cloth cover 146 (e.g., velvet) and including two generally cylindrical portions 147. The body 144 has a top surface 148, and a bottom surface including spaced pressure surface portions 150 adapted to engage and be supported on the upper surface of the stack 9 parallel to and adjacent the edges of the sheets 11 along which the narrow bands of adhesive are coated with the spaced pressure surface portions 150 engaging the upper surface of the sheets 11 at predetermined distances from the edges of the sheets 11 along which the narrow bands of adhesive are coated, and convex arcuate surface portions 152 between the pressure surface portions 150 and the top surface 148 defining a slot 154 through and extending centrally across the body 144. The convex arcuate surface portions 152 have radii with dimensions at least as great as said predetermined distances to restrict curling of sheets 11 of paper pulled from the dispenser through the slot 154, and the steel balls 145 included in the body 144 provide sufficient weight to afford pulling one of the sheets 11 from the stack 9 through the slot 148 without substantially lifting the body 144 from the stack 9.

The base 141 has an upwardly projecting generally cylindrical peripheral wall 158 projecting at right angles away from the support surface portion 143. The peripheral wall 158 is adapted to receive a circular periphery 160 of the body 144 in close fitting relationship to provide means for positioning the body 144 above the base 141. When the two generally cylindrical portions 147 of the body 144 are manually positioned with their axes parallel to and adjacent the opposite edges of the sheets along which the narrow bands of adhesive are coated, the conformation of the balls 145 in the body 144 around the stack 9 initially so located provides means for locating the stack 9 with the edges of the sheets 11 along which the narrow bands of adhesive are coated generally parallel to the arcuate surface portions 152 and with the slot 154 extending generally transversely across the stack 9 centrally between those edges.

With any of the dispensers described above, when the end of a sheet that initially projects through the slot in the body is manually pulled through the slot, the opposite end of the sheet being pulled will carry with it the end of the underlying sheet due to the adhesive engagement therebetween while that end of the underlying sheet slides over the sheet beneath it to which it is not adhesively attached. After the opposite end of the sheet being pulled and the adhesively attached end of the underlying sheet move from under the pressure surface portion over them, the follow the adjacent arcuate surface portion and move through the slot, whereupon the adhesive layer on the sheet being pulled will peel away from the underlying sheet to separate it from the dispenser and leave the end of the underlying sheet projecting through the slot.

Having thus described the present invention with respect to several embodiments thereof it will be appreciated that further changes may be made without departing from the spirit or scope of the invention.

I claim:

1. A dispenser for sheets of note paper disposed in a stack having upper and lower surfaces with each of said sheets having a narrow band of adhesive coated on one surface along one edge by which the sheets are adhered together and with the sheets being stacked with the band of adhesive of adjacent sheets at alternate opposite edges of the stack, said dispenser comprising:

a base part having a bottom surface adapted to be supported on a horizontal support surface and a top surface comprising a generally planar support surface portion adapted to support the lower surface of the stack;

a body part having a top surface, and a bottom surface including spaced pressure surface portions adapted to engage and be supported on the upper surface of the stack adjacent the edges of the sheets along which the narrow bands of adhesive are coated with the spaced pressure surface portions engaging the upper surface of the sheets at predetermined distances from the edges of the sheets along which the narrow bands of adhesive are coated, and convex arcuate surface portions between said pressure surface portions and said top surface defining a slot through and extending centrally across said body part, said convex arcuate surface portions having radii with a dimension as least as large as said predetermined distances to restrict curling of sheets of paper pulled from the dispenser through the slot, said body part having sufficient weight to afford pulling a sheet from the stack through the slot without substantially lifting the body part from the stack;

means for positioning said body part above said base part comprising said base part having a generally cylindrical periphery disposed at generally a right angle to said support surface portion and said body part having a generally cylindrical peripheral wall adapted to project along said periphery with the stack between said parts; and means for locating the stack with the edges of the sheets along which the narrow bands of adhesive are coated generally parallel to said arcuate surface portions and with said slot extending generally transversely across the stack centrally between those edges comprising said body part having locating lugs projecting toward said base part adapted to receive opposite sides of the stack in close fitting relationship said base part having a circular groove recessed from said support surface portion adapted to receive said locating lugs in any orientation of said slot transverse to said base part to afford dispensing the last sheets in the stack.

2. A dispenser for sheets of note paper disposed in a stack having upper and lower surfaces with each of said sheets having a narrow band of adhesive coated on one surface along one edge by which the sheets are adhered together and with the sheets being stacked with the band of adhesive of adjacent sheets at alternate opposite edges of the stack, said dispenser comprising:

a base part having a bottom surface adapted to be supported on a horizontal support surface and a top surface comprising a generally planar support surface portion adapted to support the lower surface of the stack;

a body part having a top surface, and a bottom surface including spaced pressure surface portions adapted to engage and be supported on the upper surface of the stack adjacent the edges of the sheets along which the narrow bands of adhesive are coated with the spaced pressure surface portions engaging the upper surface of the sheets at predetermined distances from the edges of the sheets along which the narrow bands of adhesive are coated, and convex arcuate surface portions between said pressure surface portions and said top surface defining a slot through and extending centrally across said body part, said convex arcuate surface portions having radii with a dimension as least as large as said predetermined distances to restrict curling of sheets of paper pulled from the dispenser through the slot, said body part having sufficient weight to afford pulling a sheet from the stack through the slot without substantially lifting the body part from the stack;

means for positioning said body part above said base part comprising said body part having a generally cylindrical periphery disposed at generally a right angle to said support surface and said base part having a generally cylindrical peripheral wall adapted to project along said periphery with the stack between said parts; and means for locating the stack with the edges of the sheets along which the narrow bands of adhesive are coated generally parallel to said arcuate surface portions and with said slot extending generally transversely across the stack centrally between those edges comprising said body part having locating lugs projecting toward said base part adapted to receive opposite sides of the stack in close fitting relationship, said base part has a circular groove recessed from said support surface portion adapted to receive said locating lugs in any orientation of said slot transverse to said base part to afford dispensing the last sheets in the stack.

3. In combination sheets of note paper disposed in a stack having upper and lower surfaces with each of said sheets having a narrow band of adhesive coated on one surface along one edge by which the sheets are adhered together and with the sheets being stacked with the band of adhesive of adjacent sheets at alternate opposite edges of the stack, and a dispenser comprising:

a base part having a bottom surface adapted to be supported on a horizontal support surface and a top surface comprising a generally planar support surface portion supporting the lower surface of the stack; and a body part having a top surface, and a bottom surface including spaced pressure surface portions engaging and being supported on the upper surface of the stack adjacent the edges of the sheets along which the narrow bands of adhesive are coated with the spaced pressure surface portions engaging the upper surface of the sheets at predetermined distances from the edges of the sheets along which the narrow bands of adhesive are coated, and convex arcuate surface portions between said pressure surface portions and said top surface defining a slot through and extending centrally across said body part, said convex arcuate surface portions having radii with a dimension as least as large as said predetermined distances to restrict curling of sheets of paper pulled from the dispenser through the slot, said body part having sufficient weight to afford pulling a sheet from the stack through the slot without substantially lifting the body part from the stack;

means for positioning said body part above said base part comprising said base part having a generally cylindrical periphery disposed at generally a right angle to said support surface portion and said body part having a generally cylindrical peripheral wall adapted to project along said periphery with the stack between said parts; and means for locating the stack with the edges of the sheets along which the narrow bands of adhesive are coated generally parallel to said arcuate surface portions and with said slot extending generally transversely across the stack centrally between those edges comprising said body part having locating lugs projecting toward said base part adapted to receive opposite sides of the stack in close fitting relationship, said base part has a circular groove recessed from said support surface portion adapted to receive said locating lugs in any orientation of said slot transverse to said base part to afford dispensing the last sheets in the stack.

4. In combination, sheets of note paper disposed in a stack having upper and lower surfaces with each of said sheets having a narrow band of adhesive coated on one surface along one edge by which the sheets are adhered together and with the sheets being stacked with the band of adhesive of adjacent sheets at alternate opposite edges of the stack, and a dispenser comprising:

a base part having a bottom surface adapted to be supported on a horizontal support surface and a top surface comprising a generally planar support surface portion supporting the lower surface of the stack; and a body part having a top surface, and a bottom surface including spaced pressure surface portions engaging and being supported on the upper surface of the stack adjacent the edges of the sheets along which the narrow bands of adhesive are coated with the spaced pressure surface portions engaging the upper surface of the sheets at predetermined distances from the edges of the sheets along which the narrow bands of adhesive are coated, and convex arcuate surface portions between said pressure surface portions and said top surface defining a slot through and extending centrally across said body part, said convex arcuate surface portions having radii with a dimension as least as large as said predetermined distances to restrict curling of sheets of paper pulled from the dispenser through the slot, said body part having sufficient weight to afford pulling a sheet from the stack through the slot without substantially lifting the body part from the stack;

means for positioning said body part above said base part comprising said body part having a generally cylindrical periphery disposed at generally a right angle to said support surface and said base part having a generally cylindrical peripheral wall adapted to project along said periphery with the stack between said parts; and means for locating the stack with the edges of the sheets along which the narrow bands of adhesive are coated generally parallel to said arcuate surface portions and with said slot extending generally transversely across the stack centrally between those edges comprising said body part having locating lugs projecting toward said base part adapted to receive opposite sides of the stack in close fitting relationship, said base part having a circular groove recessed from said support surface portion adapted to receive said locating lugs in any orientation of said slot transverse to said base part to afford dispensing the last sheets in the stack.

* * * * *